United States Patent [19]

Sprinkel et al.

[11] Patent Number: 4,987,908

[45] Date of Patent: Jan. 29, 1991

[54] THERMAL INDICATORS FOR SMOKING ARTICLES

[75] Inventors: F. Murphy Sprinkel, Glen Allen; Constance H. Morgan, Midlothian; D. Bruce Losee, Jr., Richmond, all of Va.

[73] Assignee: Philip Morris Incorporated, New York, N.Y.

[21] Appl. No.: 381,764

[22] Filed: Jul. 18, 1989

[51] Int. Cl.[5] ..... A24D 1/02; A24C 5/38; A24C 5/60

[52] U.S. Cl. ..... 131/365; 131/360; 131/284

[58] Field of Search ..... 131/362, 365, 270, 355, 131/365, 284

[56] References Cited

U.S. PATENT DOCUMENTS

| | | | |
|---|---|---|---|
| 1,515,222 | 11/1924 | Ruben . | |
| 1,676,536 | 7/1928 | Ferkel . | |
| 1,746,363 | 2/1930 | Schleicher . | |
| 1,894,015 | 1/1933 | Bernstein . | |
| 2,046,863 | 7/1936 | Allphin . | |
| 2,118,144 | 5/1938 | Berman et al. . | |
| 2,137,456 | 11/1938 | Palm, Jr. . | |
| 2,193,439 | 3/1940 | Van Doren . | |
| 2,261,473 | 11/1941 | Jennings . | |
| 2,379,459 | 4/1945 | Schreiber et al. . | |
| 2,490,933 | 12/1949 | Tornquist et al. . | |
| 2,560,537 | 7/1951 | Andersen . | |
| 2,579,738 | 12/1951 | Hargreaves . | |
| 2,782,749 | 2/1957 | Beckett et al. . | |
| 2,809,116 | 10/1957 | Laskowski . | |
| 2,849,005 | 8/1958 | Tucker et al. . | |
| 2,928,791 | 3/1960 | Loconti . | |
| 3,360,338 | 12/1967 | Edenbaum . | |
| 3,465,590 | 9/1969 | Kluth et al. . | |
| 3,523,011 | 8/1970 | Bhiwandker et al. . | |
| 3,576,761 | 4/1971 | Davis . | |
| 3,633,425 | 1/1970 | Sanford . | |
| 3,700,603 | 10/1972 | Rembaum . | |
| 3,785,336 | 1/1974 | Roszkowski . | |
| 3,827,301 | 8/1974 | Parker . | |
| 3,830,224 | 8/1974 | Vanzetti et al. . | |
| 3,874,240 | 4/1975 | Rembaum . | |
| 3,888,631 | 6/1975 | Sturzinger . | |
| 3,895,523 | 7/1975 | Nollen . | |
| 3,943,941 | 3/1976 | Boyd et al. | 131/359 |
| 3,998,210 | 12/1976 | Nosari . | |
| 4,138,357 | 2/1979 | Igarashi . | |
| 4,236,532 | 12/1980 | Schweizer et al. . | |
| 4,240,926 | 12/1980 | McNeeley . | |
| 4,583,558 | 4/1986 | Luke . | |
| 4,643,588 | 2/1987 | Postle et al. . | |
| 4,854,332 | 8/1989 | Hanakura | 131/365 |

FOREIGN PATENT DOCUMENTS

| | | | |
|---|---|---|---|
| 2212349 | 10/1973 | Fed. Rep. of Germany . | |
| 1298686 | 11/1962 | France . | |
| 2100192 | 12/1982 | United Kingdom | 131/284 |

*Primary Examiner*—V. Millin

*Attorney, Agent, or Firm*—Gerard A. deBlasi

[57] ABSTRACT

Thermal indicators for non-combustion smoking articles which physically change when heated to provide visual indications of temperature changes are disclosed. The indicators comprise waxes or other compounds which melt away to reveal colored substrates, or comprise microencapsulated chemicals which are released when heated to cause inking or dyeing. The thermal indicators are printed in variety of patterns along the length of the smoking articles to show temperature changes and to indicate whether the smoking article is finished and should be discarded.

20 Claims, 1 Drawing Sheet

FIG. 1
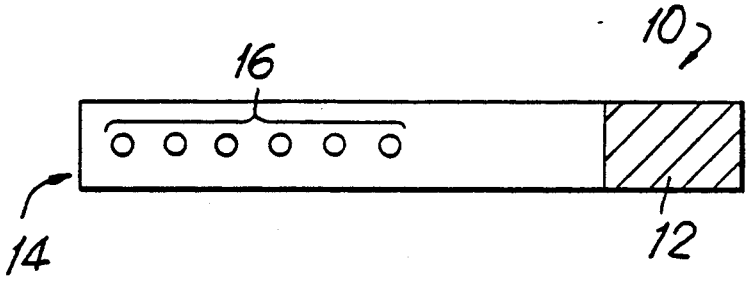
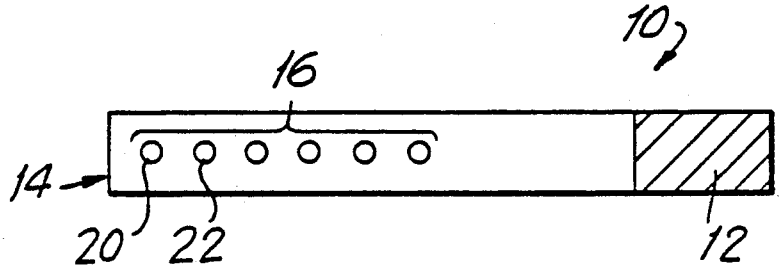
FIG. 2
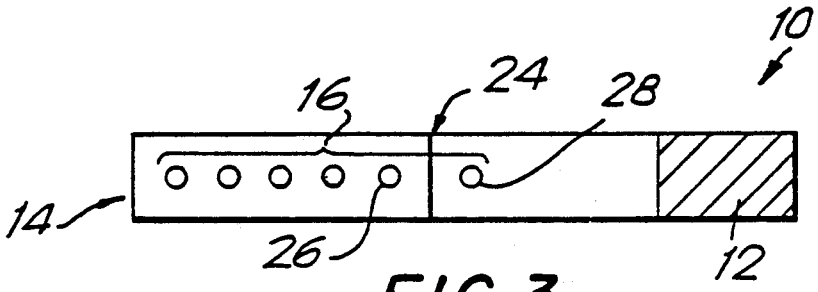
FIG. 3

THERMAL INDICATORS FOR SMOKING ARTICLES

BACKGROUND OF THE INVENTION

This invention relates to thermal indicators used on smoking articles. More particularly, this invention relates to thermal indicators embodied as waxes or other compounds which melt away to reveal colored substrates, or use microencapsulated chemicals, to indicate a predetermined temperature within the smoking article.

There are non-combustion smoking articles currently on the market that provide an alternative to conventional tobacco-burning smoking articles. Non-combustion smoking articles include smoking articles heated by electrical or chemical means, or by burning some type of heat source other than the tobacco itself. The tobacco or flavor source is heated, but is not burned. If the heat source is contained within the non-combustion smoking article, it provides no visual indication, such as a burning end, of the temperature gradient along the article. A smoker is unable to determine which portion of the smoking article is hot.

A person smoking a non-combustion smoking article must be informed that the device has begun to work. The smoker also needs information about the on-going operation of the device, for example, whether the heat source is still operating. Finally, the smoker must know when to stop puffing because the flavor or heat source is expended. Unless the smoker knows this, the smoker may try to use the device longer than is intended by the manufacturer, possibly resulting in customer dissatisfaction.

The thermal indicators used on smoking articles must not affect the flavor or safety of the smoking articles. The indicator materials must be non-toxic both prior to and after heating.

In view of the foregoing, it is an object of this invention to provide non-toxic thermal indicators for use on non-combustion smoking articles.

It is another object of this invention to provide a method for showing the internal thermal status of a non-combustion smoking article along its length.

SUMMARY OF THE INVENTION

These and other objects of the invention are accomplished in accordance with the principles of the invention by providing thermal indicators which physically change at a predetermined temperature to cause a visible color change. The thermal indicator means of the present invention may be one of two types. In the preferred embodiment, the thermal indicator may include a colored substrate applied to the surface of the smoking article to be monitored. This substrate is covered by an opaque, low melting point wax or other similar compound. In this embodiment, the wax coating melts away to reveal the colored substrate beneath. In an equally preferred embodiment, the thermal indicator may include microencapsuated chemicals which cause a color change by inking or dyeing the surface of the smoking article. These chemicals are released when the heat from the article melts the encapsulating material.

The thermal indicators may be applied to a smoking article in a variety of patterns using conventional printing techniques. The indicators are printed along the longitudinal length of the smoking article. As the internal temperature gradient of the smoking article moves down the length of the article, the indicators gradually reveal a color indication in response to the increased heat.

Further features of the invention, its nature and various advantages will be more apparent from the accompanying drawings and the following detailed description of the preferred embodiments.

BRIEF DESCRIPTION OF THE DRAWINGS

FIG. 1 shows a non-combustion smoking article with an illustrative imprint of thermal indicators in accordance with the principles of this invention.

FIG. 2 is the smoking article of FIG. 1 showing two indicators whose surface material has melted away, in response to the heating of the smoking article, revealing a colored substrate.

FIG. 3 is the smoking article of FIG. 1 showing an illustrative marking used to indicate when the smoking article is finished.

DETAILED DESCRIPTION OF THE PREFERRED EMBODIMENTS

Thermal indicators prepared in accordance with this invention are comprised of compounds which physically change to either reveal a colored substrate or create a color change as an indication of temperature change. The indicators are applied directly to the surface whose temperature is to be monitored.

In the preferred embodiment of the invention, low melting point waxes, gums (e.g., gum arabic), pectins, or fatty acid esters (e.g., bee wax) are applied to a colored substrate. The coating material is initially opaque, and remains as such until the surface whose temperature is being monitored reaches a predetermined temperature. At or near the predetermined temperature, the coating wicks and becomes clear. The coating thins and is absorbed into the surface (i.e., into the paper cigarette wrapper). The substrate, previously hidden beneath the opaque coating, becomes visible as an indication of temperature change.

The preferred coating materials include hydrocarbon waxes in the hydrocarbon range of C16 to C30. Compounds such as polyvinyl-1 alcohol or polyvinyl acetate, or long chain fatty acids, such as stearic acid, may be added to the coating materials as hardening agents. The coating materials may be selected and combined such that the coating will melt to reveal a color indication when subjected to a predetermined temperature within the range of 40 degrees to 220 degrees Centigrade.

The substrate may be printed in a wide variety of colors and may be printed in a variety of patterns or letters. More than one color ink may be used on a single smoking article. The thermal indicator's substrate may be selected to enhance the appearance of the smoking article to which it is applied. The substrate used for cigarettes may comprise conventional print ink, or any other non-toxic colorant, applied directly to the cigarette wrapper. The preferred coloring agent of the ink is carbon.

Referring to FIG. 1, as the smoker draws on the proximal end of smoking article 10, air is drawn though distal end 14, and past the internal heat source of the smoking article, causing the air to become heated. The heated air and flavored aerosol (which is released from the flavor source disposed within smoking article 10) are drawn down the length of the smoking article, through the filter 12, and into the smoker's mouth. Often, non-combustion smoking articles (to which the thermal indicators of this invention may be applied) are lined with foil. The foil conducts heat, gradually, back toward filter 12. As smoking progresses, an internal temperature gradient is created within smoking article 10. The smoking article is hottest at distal end 14 where the device is lit or otherwise initially heated, and cooler toward filter 12. The heated aerosol, heat-conducting foil, and possibly the heat source itself (e.g., a carbon rod burning toward filter 12) cause the temperature to increase down the length of article 10 as smoking continues. It is this temperature gradient which causes certain indicators to heat sufficiently to cause a color change, while other thermal indicators, located on cooler portions of the smoking article, remain invisible (i.e., they have not been sufficiently heated to cause the opaque coatings or encapsulating materials to melt).

FIG. 1 shows a smoking article 10 imprinted with thermal indicators collectively indicated by reference numeral 16. In an illustrative embodiment of this invention, the thermal indicators are printed in a series of small dots. Indicators 16 are printed at distal end 14 and down the length of smoking article 10. In alternative embodiments of the invention, indicators 16 may be printed or sprayed onto the outer surface of smoking article 10 as lines or letters, or in any of a variety of patterns.

FIG. 2 shows the smoking article of FIG. 1 after the device has begun to operate. Before article 10 is smoked, all of the indicators 16 are opaque (as shown in FIG. 1). At the beginning of smoking, distal end 14 is the first portion to experience a temperature rise. When this happens, the surface layer of the indicator 18 closest to distal end 14 begins to melt, revealing the colored substrate beneath. As smoking progresses, the surface of indicator 20 also melts, revealing the colored substrate. Thermal indicator 22 will be the next to change, as the internal temperature gradient of the smoking article progressively moves toward the proximal end. In this way, the smoker is alerted that smoking article 10 is still hot and is still operating.

FIG. 3 shows the smoking article of FIG. 1, having means for indicating when smoking article 10 is finished. This embodiment is particularly suited for smoking articles comprising a heat source which extends longitudinally down the length of the article and heats gradually from distal end 14 toward filter 12 (such as a burning carbon rod).

In FIG. 3, a marking 24 is printed on the surface of article 10 of FIG. 1. Marking 24 is preferably printed in ink, but may also be printed with the same materials as indicators 16. Marking 24 is disposed before the thermal indicator closest to filter 12, i.e., between indicators 26 and 28. Thermal indicator 28, located beyond marking 24, changes color when the area surrounding the proximal end of article 10 becomes hot. This may occur, for example, when a heat source, such as a burning rod of carbon, burns to the end of article 10. Indicator 28 alerts the smoker that smoking article 10 is finished and should be discarded.

In an alternative embodiment of the invention, the thermal indicators comprise microencapsulated chemicals. The microencapsulated chemicals include inks and dyes, color producing materials, solvents for the inks, water, or alcohols. Precursors to inks or dyes (i.e., selected components of multiple-component inks or dyes) may also be microencapsulated. When the monitored surface reaches a predetermined temperature, the encapsulating materials melt and release the encased chemicals, resulting in the inking or dyeing of the smoking article. In this embodiment, a solution comprising microencapsulated chemicals is printed directly on the smoking article. There is no colored substrate beneath the microencapsulated chemical solution.

Thermal indicators in accordance with this invention may be applied to smoking articles using standard methods of printing on cigarette wrappers. Preferably, the indicators are applied to the smoking article by means of a print wheel. This method is suitable for applying indicators comprising microencapsulated chemicals.

Where the thermal indicator includes a colored substrate beneath a waxy coating, a more complicated printing procedure is required. The substrate, preferably printed with conventional print ink, is first applied to the cigarette wrapper by a first print wheel. The opaque wax coating is superimposed upon the substrate by a second print wheel. In an alternative embodiment, the substrate of the indicator is imprinted on the cigarette wrapper by means of spray jets, in lieu of using the first print wheel. The opaque wax coating is again superimposed upon the substrate by a print wheel.

In embodiments utilizing a colored substrate and opaque wax coating, the wax may be applied to the smoking article either hot or cold. The wax is preferably applied when cod. Solvents are added to the wax to obtain the desired wax viscosity for proper bonding of the cold wax to the substrate and cigarette paper. Food-grade vegetable oil is a solvent suitable for this application.

It will be understood that the foregoing is merely illustrative of the principles of the invention, and that various modifications can be made by those skilled in the art of the invention. For example, the indicator material may be printed in a continuous line down the length of smoking article 10, in pace of the pattern of dots, in the embodiment of FIG. 1.

We claim:

1. A method for determining whether a non-combustion smoking article has reached a predetermined operating state comprising the steps of:

applying a colorant to the outer surface and along the length of the smoking article in a predetermined pattern from a distal end of said article to a first predetermined point during manufacture;

applying a low melting point material to the smoking article such that it covers said colorant, during manufacture;

marking the smoking article at a second predetermined point, said second predetermined point being disposed between said distal end and said first predetermined point during manufacture; and monitoring the portion of the length of said smoking article between said marking and said first predetermined point for color changes indicating that the smoking article has reached said predetermined operating state during smoking.

2. A method for determining whether a non-combustion smoking article has reached a predetermined operating states comprising the steps of:

applying a non-toxic fluid comprising microencapulated chemicals to the outer surface of and along the length of the smoking article in a predetermined pattern, from a distal end of said article to a first predetermined point during manufacture;

marking the smoking article at a second predetermined point, said second predetermined point being disposed between said distal end and said first predetermined point during manufacture; and monitoring the portion of the length of said smoking article between said marking and said first predetermined point for color changes that indicate that the microencapsulated chemicals have been heated to a predetermined temperature to release the chemicals, and to indicate that the smoking article has reached a predetermined operating state.

3. A non-combustion smoking article having means for detecting internal temperature changes, comprising:

a non-toxic substrate visible against and printed on the outer surface of the smoking article in a predetermined pattern, from the distal end to a predetermined point; and a low melting point material capable of melting at a predetermined temperature, disposed on the outer surface of said smoking article, over at least the substrate.

4. The article of claim 3 wherein said substrate comprises a conventional printing ink using carbon as a coloring agent.

5. The article of claim 4 wherein said colored substrate includes a plurality of colors.

6. The article of claim 5 wherein said low melting point material is a compound selected from among the group consisting of hydrocarbon waxes, gum arabic, pectin, and fatty acid esters.

7. The article claim 6 wherein said hydrocarbon wax comprises a wax in the hydrocarbon range of C16 to C30.

8. The article of claim 7 wherein said low melting point material further comprises a hardening additive.

9. The article of claim 8 wherein said hardening additive includes polyvinyl acetate.

10. The article of claim 9 wherein said hardening additive includes stearic acid.

11. The system of claim 10 wherein said predetermined pattern extends from the distal end of said smoking article to a predetermined point.

12. The article of claim 11 wherein said predetermined pattern comprises a series of dots.

13. The article of claim 12 further comprising means for indicating that the smoking article is finished.

14. A non-combustion smoking article having means for detecting whether the smoking article has reached a predetermined operating state, comprising:

a non-toxic substrate, visible against and printed on the outer surface of the smoking article in a predetermined pattern from a distal end of said smoking article to a first predetermined point;

a low melting point material capable of melting at a predetermined temperature, disposed on the outer surface of said smoking article over at least the substrate;

a marking, disposed at a second predetermined point, between said distal end and said first predetermined point, to indicate that said smoking article has reached a predetermined operating state when the portion of said substrate disposed between said marking and said first predetermined point becomes visible.

15. A non-combustion smoking article having means for detecting internal temperature changes comprising:

containment means disposed on the outer surface of the smoking article in a predetermined pattern, from the distal end to a predetermined point; and a non-toxic fluid disposed in said containment means, said fluid being released when heated to a predetermined temperature to dye the outer surface of said smoking article.

16. The article of claim 15, wherein said containment means is microencapsulating material for microencapsulating said fluid.

17. The article of claim 16 wherein said predetermined pattern extends from the distal end of said smoking article to a predetermined point.

18. The article of claim 17 wherein said predetermined pattern comprises a series of dots.

19. The article of claim 18 further comprising means for indicating that the smoking article is finished.

20. A non-combustion smoking article having means for detecting whether the smoking article has reached a predetermined operating state, comprising:

a non-toxic fluid comprising microencapsulated chemicals disposed on the outer surface of and along the length of the smoking article in a predetermined pattern, from a distal end of said smoking article to a first predetermined point; and a marking, disposed at a second predetermined point between said distal end and said first predetermined point, to indicate that said smoking article has reached a predetermined operating state when the portion of said fluid disposed between said marking and said first predetermined point changes color.

* * * * *